US010750809B2

(12) United States Patent
Kim et al.

(10) Patent No.: US 10,750,809 B2
(45) Date of Patent: Aug. 25, 2020

(54) ARTIFICIAL HAIR APPARATUS AND METHOD

(71) Applicant: SHAKE-N-GO FASHION, INC., Port Washington, NY (US)

(72) Inventors: James K. Kim, Manhasset, NY (US); Peter Ough, Bayside, NY (US); Hye Sun Kim, Port Washington, NY (US)

(73) Assignee: SHAKE-N-GO FASHION, INC., Port Washington, NY (US)

( * ) Notice: Subject to any disclaimer, the term of this patent is extended or adjusted under 35 U.S.C. 154(b) by 837 days.

(21) Appl. No.: 15/267,603

(22) Filed: Sep. 16, 2016

(65) Prior Publication Data

US 2017/0079355 A1 Mar. 23, 2017

Related U.S. Application Data

(60) Provisional application No. 62/220,029, filed on Sep. 17, 2015, provisional application No. 62/258,879, filed on Nov. 23, 2015.

(51) Int. Cl.
*A41G 5/00* (2006.01)
*A41G 3/00* (2006.01)

(52) U.S. Cl.
CPC ..... *A41G 5/004* (2013.01); *A41G 3/005* (2013.01); *A41G 3/0066* (2013.01)

(58) Field of Classification Search
CPC ..... A41G 3/00; A41G 3/0008; A41G 3/0016; A41G 3/0033; A41G 3/0041; A41G 3/005
See application file for complete search history.

(56) References Cited

U.S. PATENT DOCUMENTS 3,424,175 A * 1/1969 Hartwich ..... A41G 3/00 132/53
3,777,768 A 12/1973 Scigliano
3,862,638 A * 1/1975 Fannin ..... A41G 3/0016 132/53

(Continued)

FOREIGN PATENT DOCUMENTS

FR 2913567 A1 * 9/2008

OTHER PUBLICATIONS

"Vivica A. Fox Creates New Cornrow Cap for Weave Sew-Ins," http://Bossip.com; Date Published: Sep. 16, 2015; Date Accessed: Nov. 1, 2016; URL: http://bossip.com/1227770/unbeweavablevivicaafoxcreatescornrowcaptohelpsistasgetaneasiersewinbutwouldyoubuyit/.

*Primary Examiner* — Rachel R Steitz
(74) *Attorney, Agent, or Firm* — Cowan, Liebowitz & Latman, P.C.; Mark Montague; Brian R. Volk

(57) ABSTRACT

An artificial hair comprises a mesh layer configured to fit around a circumference of a user's head comprising an inner surface, an outer surface, a front region, a rear region, and a circumferential edge region that extends around the front region and the rear region; a filament coupled to the outer surface of the mesh layer, at least a portion of the filament being disposed in each of the front region, the rear region and on the circumferential edge region of the mesh layer; a plurality of first hair members coupled to the filament; and a plurality of second hair members slidably disposed between the filament and the mesh layer, the first hair members comprising a first length and the second hair members comprising a second length, the first length being greater than the second length.

16 Claims, 18 Drawing Sheets

100

(56) References Cited

U.S. PATENT DOCUMENTS

| | | | | |
|---|---|---|---|---|
| 4,386,619 | A | 6/1983 | Williams | |
| 5,634,478 | A | 6/1997 | Shakir | |
| 5,746,232 | A * | 5/1998 | Martin | A41G 3/00 132/54 |
| 6,016,814 | A | 1/2000 | Elliott | |
| 6,830,054 | B1 | 12/2004 | Ross-Kuehn | |
| 7,735,495 | B2 | 6/2010 | Lane et al. | |
| 8,261,753 | B2 | 9/2012 | Newman et al. | |
| 8,578,945 | B2 | 11/2013 | Sasayama | |
| 2004/0168696 | A1 * | 9/2004 | Cox | A41G 3/0016 132/54 |
| 2007/0199571 | A1 | 8/2007 | McCulloch | |
| 2007/0221240 | A1 | 9/2007 | Junsuh Lee | |
| 2008/0041405 | A1 | 2/2008 | Kitsu et al. | |
| 2013/0125913 | A1 | 5/2013 | Ellery | |
| 2015/0013708 | A1 | 1/2015 | Chamberlain | |
| 2017/0095026 | A1 | 4/2017 | Chung | |

* cited by examiner

100

ARTIFICIAL HAIR APPARATUS AND METHOD

REFERENCE TO RELATED APPLICATIONS

This application claims priority to U.S. Provisional Application Nos. 62/220,029 and 62/258,879 filed on Sep. 17, 2015 and Nov. 23, 2015, respectively, the entire content of each of which is incorporate herein by reference.

BACKGROUND OF THE INVENTION

1. Field of the Invention

The present invention relates generally to artificial hair, and more particularly, to an artificial hair apparatus and method of manufacturing the artificial hair apparatus.

2. Description of the Related Art

Wigs are used by people to enhance their appearance and to conceal their natural hair. Wigs generally include multiple strands of hair attached to a cap to form a unit that can be secured to an user's scalp. Hair weaves and hair extensions are also used by people to either conceal or supplement their natural hair. In some cases, people use wigs when they are experiencing baldness or thinning of their natural hair. For those experiencing baldness or thinning of natural hair, use of wigs provides an alternative to use of potentially dangerous hair growth drugs or chemicals, or uncomfortable hair plugs. In other cases, people use wigs for temporary purposes when they are undergoing medical treatments that result in loss of their hair, such as chemotherapy.

Wigs are also used to provide a user with an alternative hair color in order to improve their appearance. Furthermore, wigs can be used by people to present an alternative texture to their own hair, such as changing their hair from straight to curly. Just as many people enjoy accessorizing their wardrobe, people who wear wigs enjoy changing and enhancing their appearance.

SUMMARY OF THE INVENTION

An embodiment provides an artificial hair apparatus. The apparatus comprises a mesh layer configured to fit around a circumference of a user's head comprising an inner surface, an outer surface, a front region, a rear region, and a circumferential edge region that extends around the front region and the rear region; a filament coupled to the outer surface of the mesh layer, at least a portion of the filament being disposed in each of the front region, the rear region and on the circumferential edge region of the mesh layer; a plurality of first hair members coupled to the filament; and a plurality of second hair members slidably disposed between the filament and the mesh layer, the first hair members comprising a first length and the second hair members comprising a second length, the first length being greater than the second length.

According to further embodiments: the circumferential edge region comprises a rear edge portion, a side edge portion, a temple edge portion, and a front edge portion, and wherein the rear edge portion and the front edge portion are substantially inelastic and the side edge portion and the temple edge portion are substantially elastic; the circumferential edge region comprises a side edge portion comprising a first side edge and a second side edge, and wherein the filament is coupled to the rear region of the mesh layer from substantially the first edge across the mesh layer in a transverse direction to the second side edge; the filament is disposed on the mesh layer in a plurality of rows across the mesh layer, and wherein at least one end of each of the second hair members is disposed between each of the rows of the filament on the outer surface of the mesh layer; the rows of filament comprise a first distance between each row in the rear region and a second distance between each row in the front region, and wherein the first distance is greater than the second distance; the circumferential edge region comprises a front edge portion comprising a first front end edge and a second front end edge, and wherein the filament is coupled to the front region of the mesh layer from substantially the first front end edge across the mesh layer in a serpentine manner perpendicular to the transverse direction to substantially the second front end edge; the filament is coupled to the rear region and the front region of the mesh layer in a substantially serpentine manner; the first hair members are distributed at a first predetermined spacing along the filament in the rear region and at a second predetermined spacing along the filament in the front region, and wherein the first predetermined spacing is greater than the second predetermined spacing; the second hair members do not comprise straight hair; and the first hair members and the second hair members are not directly coupled to each other.

An additional embodiment provides an artificial hair apparatus. The apparatus comprises a mesh layer configured to fit around a circumference of a user's head comprising an inner surface, an outer surface, a front region, a rear region, and a circumferential edge region that extends around the front region and the rear region; and a filament coupled to the outer surface of the mesh layer in a plurality of rows, at least a portion of the filament being disposed in each of the front region and the rear region of the mesh layer in one of a longitudinal direction and a transverse direction.

According to further embodiments: the circumferential edge region comprises a rear edge portion, a side edge portion, a temple edge portion, and a front edge portion, and wherein the rear edge portion and the front edge portion are substantially inelastic and the side edge portion and the temple edge portion are substantially elastic; the circumferential edge region comprises a side edge portion comprising a first side edge and a second side edge, and wherein the filament is coupled to the rear region of the mesh layer from substantially the first edge across the mesh layer in the transverse direction to the second side edge; the rows of filament comprise a first distance between each row in the rear region and a second distance between each row in the front region, and wherein the first distance is greater than the second distance; and the circumferential edge region comprises a front edge portion comprising a first front end edge and a second front end edge, and wherein the filament is coupled to the front region of the mesh layer from substantially the first front end edge across the mesh layer in a serpentine manner to substantially the second front end edge.

An additional embodiment provides a method of manufacturing an artificial hair apparatus. The method comprises providing a mesh layer configured to fit around a circumference of a user's head comprising an inner surface, an outer surface, a front region, a rear region, and a circumferential edge region that extends around the front region and the rear region; coupling a filament to the outer surface of the mesh layer, at least a portion of the filament being disposed in each of the front region, the rear region and on the circumferential edge region of the mesh layer; and coupling a plurality of first hair members to the filament.

According to further embodiments: a plurality of second hair members are crocheted between the filament and the mesh layer, the first hair members comprising a first length and the second hair members comprise a second length, and wherein the first length is greater than the second length; the filament is coupled to the rear region and the front region of the mesh layer in a substantially serpentine manner; the first hair members are distributed at a first predetermined spacing along the filament in the rear region and at a second predetermined spacing along the filament in the front region, and wherein the first predetermined spacing is greater than the second predetermined spacing; the first hair members and the second hair members are not directly coupled to each other; the mesh layer is constructed of a material configured to maintain the shape of a person's scalp without a supporting structure.

An additional embodiment provides a kit comprising: a mesh layer configured to fit around a circumference of a user's head comprising an inner surface, an outer surface, a front region, a rear region, and a circumferential edge region that extends around the front region and the rear region; a filament; a plurality of first hair members; and a plurality of second hair members, the first hair members comprising a first length and the second hair members comprise a second length, and wherein the first length is greater than the second length.

An additional embodiment provides a method of assembling a kit. The method comprises: providing a mesh layer configured to fit around a circumference of a user's head comprising an inner surface, an outer surface, a front region, a rear region, and a circumferential edge region that extends around the front region and the rear region, a filament, a plurality of members; and inserting the mesh layer, the filament, the hair members into a package.

According to further embodiments: the plurality of hair members comprises a plurality of first hair members and a plurality of second hair members, the first hair members comprising a first length and the second hair members comprising a second length, and wherein the first length is greater than the second length.

An additional embodiment provides an artificial hair apparatus. The apparatus comprises: a mesh layer configured to fit around a circumference of a user's head comprising a center member, side members, a band member, an inner surface, an outer surface, a front region, and a rear region, wherein the mesh layer is constructed of a material that maintains the shape of a person's scalp without a supporting structure disposed in contact with the mesh layer.

According to further embodiments: the center member extends from the front region to the rear region, the side members each being disposed on opposite sides of the center member, and the center member being coupled to the side members; the center member comprises first apertures comprising a first predetermined front width corresponding to the front region and a first predetermined rear width corresponding to the rear region, wherein the first predetermined front width is at least one of different from, smaller than, larger then, and equal to the first predetermined rear width; the center member comprises a front center member and a rear center member coupled together along a center seam; first apertures of the front center member comprise a predetermined front center width and second apertures of the rear center member comprise a predetermined rear center width, wherein the predetermined front center width is at least one of different from, smaller than, equal to, or larger than the predetermined rear center width; and the material comprises at least one of polyester, nylon and spandex.

An additional embodiment provides a method of manufacturing an artificial hair apparatus. The method comprises providing a mesh layer configured to fit around a circumference of a user's head comprising a center member, side members, a band member, an inner surface, an outer surface, a front region, and a rear region, wherein the mesh layer is constructed of a material that maintains the shape of a person's scalp without a supporting structure disposed in contact with the mesh layer; the center member is coupled to the side members, wherein the center member extends from the front region to the rear region and the side members are each disposed on opposite sides of the center member; the center member comprises first apertures comprising a first predetermined front width corresponding to the front region and a first predetermined rear width corresponding to the rear region, wherein the first predetermined front width is at least one of different from, smaller than, larger then, and equal to the first predetermined rear width; providing the center member comprising a front center member and a rear center member and coupling the front center member and the rear center member together along a center seam; providing first apertures of the front center member that comprise a predetermined front center width and providing second apertures comprising a predetermined rear center width, wherein the predetermined front center width is at least one of different from, smaller than, equal to, or larger than the predetermined rear center width; and the material comprises at least one of polyester, nylon and spandex.

An additional embodiment provides an artificial hair apparatus configured to cover a portion of a user's scalp. The apparatus comprises a perimeter edge comprising fringe hair coupled to at least a portion thereof; a mesh layer comprising temple regions, a forehead region, and a top region; and a filament coupled to the top region of the mesh layer.

According to further embodiments: the fringe hair comprises at least one of curly, straight, crimped, and wavy hair textures and combinations thereof; the filament is coupled to the mesh layer in at least one of a corn row, crown part, diagonal part, side bang part, side part, center part, quadrant part manner; the perimeter edge does not extend around the circumference of the user's scalp; and the method comprises using the artificial hair apparatus comprising: trimming the perimeter edge to a size that corresponds to the user's hairline and securing the artificial hair apparatus by at least one of weaving, stitching, crocheting, and gluing the mesh layer to the user's scalp.

An additional embodiment provides a kit for an artificial hair apparatus. The kit comprises a mesh layer configured to fit around a circumference of a user's head comprising an inner surface, an outer surface, a front region, a rear region, and a circumferential edge region that extends around the front region and the rear region; a filament coupled to the outer surface of the mesh layer, at least a portion of the filament being disposed in each of the front region, the rear region and on the circumferential edge region of the mesh layer; and a plurality of hair members slidably disposed between the filament and the mesh layer.

According to further embodiments: the circumferential edge region comprises a rear edge portion, a side edge portion, a temple edge portion, and a front edge portion, and wherein the rear edge portion and the front edge portion are substantially inelastic and the side edge portion and the temple edge portion are substantially elastic; the circumferential edge region comprises a side edge portion comprising a first side edge and a second side edge, and wherein the filament is coupled to the rear region of the mesh layer from substantially the first edge across the mesh layer in a transverse direction to the second side edge; the filament is disposed on the mesh layer in a plurality of rows across the mesh layer, and wherein at least one end of each of the hair members is disposed between each of the rows of the filament on the outer surface of the mesh layer; the rows of filament comprise a first distance between each row in the rear region and a second distance between each row in the front region, and wherein the first distance is greater than the second distance; the circumferential edge region comprises a front edge portion comprising a first front end edge and a second front end edge, and wherein the filament is coupled to the front region of the mesh layer from substantially the first front end edge across the mesh layer in a serpentine manner perpendicular to the transverse direction to substantially the second front end edge; the filament is coupled to the rear region and the front region of the mesh layer in a substantially serpentine manner; and the hair members do not comprise straight hair.

BRIEF DESCRIPTION OF THE DRAWINGS

The above and other aspects, features and advantages of certain embodiments will be more apparent from the following detailed description taken in conjunction with the accompanying drawings, in which.

DETAILED DESCRIPTION OF THE PRESENT INVENTION

Figure 1:
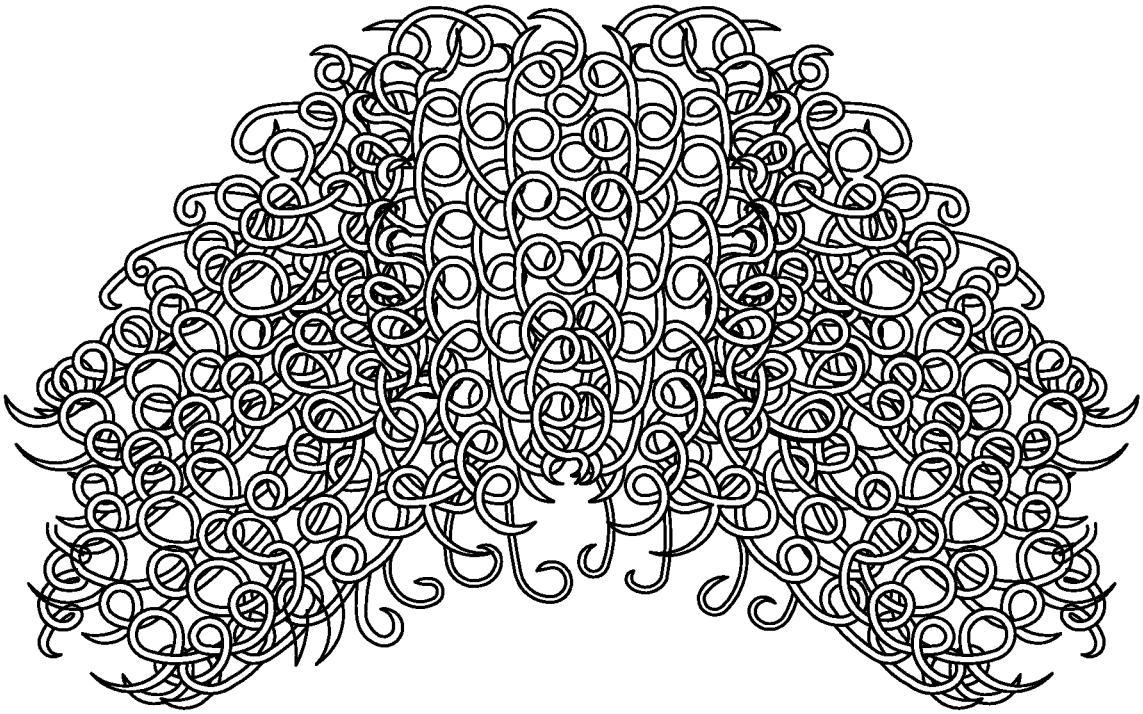
FIG. 1 illustrates a perspective view of an artificial hair apparatus.

The following detailed description of certain embodiments will be made in reference to the accompanying drawings. In the detailed description, explanation about related functions or constructions known in the art are omitted for the sake of clearness in understanding the concept of the invention, to avoid obscuring the invention with unnecessary detail.

Crochet cap-style wigs have become more desirable to consumers. A crochet cap wig generally includes a mesh cap configured to fit around a human head and a filament attached to the mesh cap according to a predetermined pattern. The filament may be, for example, a braid of synthetic hair that traverses the mesh cap from one side to the other in multiple rows. Bundles of artificial hair are crocheted to the filament to create a natural-appearing and fashionable artificial hair wig.

Some users prefer to attach bundles of hair to their scalp using crocheting methods. For example, some users braid their hair tightly to their scalp in, for example, what is referred to as a "corn row," and then crochet bundles of artificial hair to the corn row braid on the users' scalp. This can also be accomplished by covering the user's natural scalp with a mesh cap that has artificial braids, or some other suitable point of attachment, for crocheting the bundles of hair to the user's scalp. The crochet-style hair wigs provide the user with the ability to attach artificial hair to their scalp according to their own style and preference.

Embodiments of the invention, as further described herein, provide advantages over conventional crochet-style wigs. The embodiments described herein include wig apparatuses, methods of manufacturing wigs, kits for assembling wigs, methods of assembling kits for wigs, and packaging for wigs and wig kits.

In particular, certain embodiments described herein provide a wig configured to include artificial hair of varying lengths. Artificial hair of a certain length conceals the wig's mesh cap layer resulting in an improved natural appearance of the wig. The artificial hair that conceals the mesh layer may be coupled to the wig such that it is adjustable, which allows a user of the wig to customize the wig to their own preferences. In particular, the wig described herein may include separate groups of artificial hair, with one group of artificial hair positioned to conceal the mesh layer of the wig and the other group of artificial hair positioned to flow lengthwise away from the mesh layer, similarly to natural hair.

According to further embodiments, the wig includes an adjustment member for adjustably securing the wig to a user's head. The adjustment member is coupled to the mesh layer around a circumference of the wig and includes elastic and inelastic regions. The elastic and inelastic regions of the adjustment member allow the wig to be securely fit to the user's head while retaining proper positioning on the user's head for a natural appearance and comfortable fit.

According to still further embodiments, the wig includes a mesh cap layer that has a sufficiently rigid structure such that the mesh cap maintains its shape when placed on a surface. That is, the mesh cap is constructed of a material that is flexible, but is also sufficiently rigid so that it does not collapse when placed on a surface without any additional supporting structure such as, for example, a mannequin's head or other suitable object. The thickness of the mesh cap's material, as well as the shape of the holes of the mesh cap, also contributes to the mesh cap's collapse-resistant nature. In this embodiment, the user may attach artificial hair to the mesh cap without the need for additional supporting structure. Mesh caps on conventional wigs do not maintain their shape without additional supporting structure. This makes it difficult for the user to attach artificial hair to the mesh cap in a way that will translate to wearing the completed wig on their own head. In particular, when the user attaches artificial hair to a conventional mesh cap, there is a potential that the user is attaching hair to inappropriate locations on the conventional mesh cap since it is not maintained at an appropriate shape. Thus, using conventional mesh caps, the user must, through trial and error, attach and remove wefts of artificial hair until the wig achieves the desired appearance, rendering the user's experience difficult, frustrating and time-consuming.

In yet further embodiments, the wig may be sold as a kit with any of its constituent components, as further described herein, in either a completely unassembled or partially assembled configuration. This allows the user to customize the wig according to their own personal style and preferences when they proceed with assembling the wig.

In an further embodiment, the wig is configured to cover a portion of the user's scalp. This partial scalp-covering wig is useful for people that have partial balding or thinning of a portion of the natural hair on their scalp. The partial wig covers bald spots and/or areas of thinning hair, but does not cover the user's entire head. The partial wig may also be used to provide a user with a portion of artificial hair that has a color matching and/or contrasting with the user's natural hair. Thus, the partial wig may be used by a user whether or not they have bald spots and/or areas of thinning hair in order to add a streak of color to their natural hair.

The phrase "artificial hair," as used herein, refers to synthetic hair products as well as human hair or animal hair and combinations thereof. The artificial hair may be embodied in various traditional hair colors, such as black, brown, blonde, and red, as well as non-traditional hair colors, such as blue, green, and purple, and combinations thereof, including individual strands of hair having two or more colors.

The term "user," as used herein, refers to any purchaser of the wig configured according to any of the embodiments disclosed herein, including, but not limited to, individual members of the public, wholesale distributors, retail merchants, manufacturers, importers and exporters of the wig and related components of the wig.

Reference to individual embodiments, whether by number of embodiment or relevant feature of the embodiment, is used for convenience in describing such embodiments. Moreover, reference to individual embodiments does not indicate that any of such embodiments are preferred over any other embodiments. Furthermore, each individual embodiment may be combined with any other individual embodiment whether or not expressly stated.

FIG. 1 illustrates a perspective view of an artificial hair apparatus 100. The artificial hair apparatus 100 is a wig that covers a user's natural hair or scalp. The artificial hair apparatus 100 is embodied in various traditional hair colors, such as black, brown, blonde, and red, as well as non-traditional hair colors, such as blue, green, and purple, and combinations thereof. The artificial hair apparatus 100 is embodied in various hair textures, such as curly, straight, crimped, wavy, and combinations thereof. As described herein, the artificial hair apparatus 100 includes artificial hair of varying lengths disposed in varying amounts on the artificial hair apparatus 100 to provide a user with a natural and fashionable appearance. Also, the artificial hair apparatus 100 includes various components designed to hold the artificial hair apparatus 100 to a user's scalp in a comfortable and natural-appearing manner.

Figure 2A:
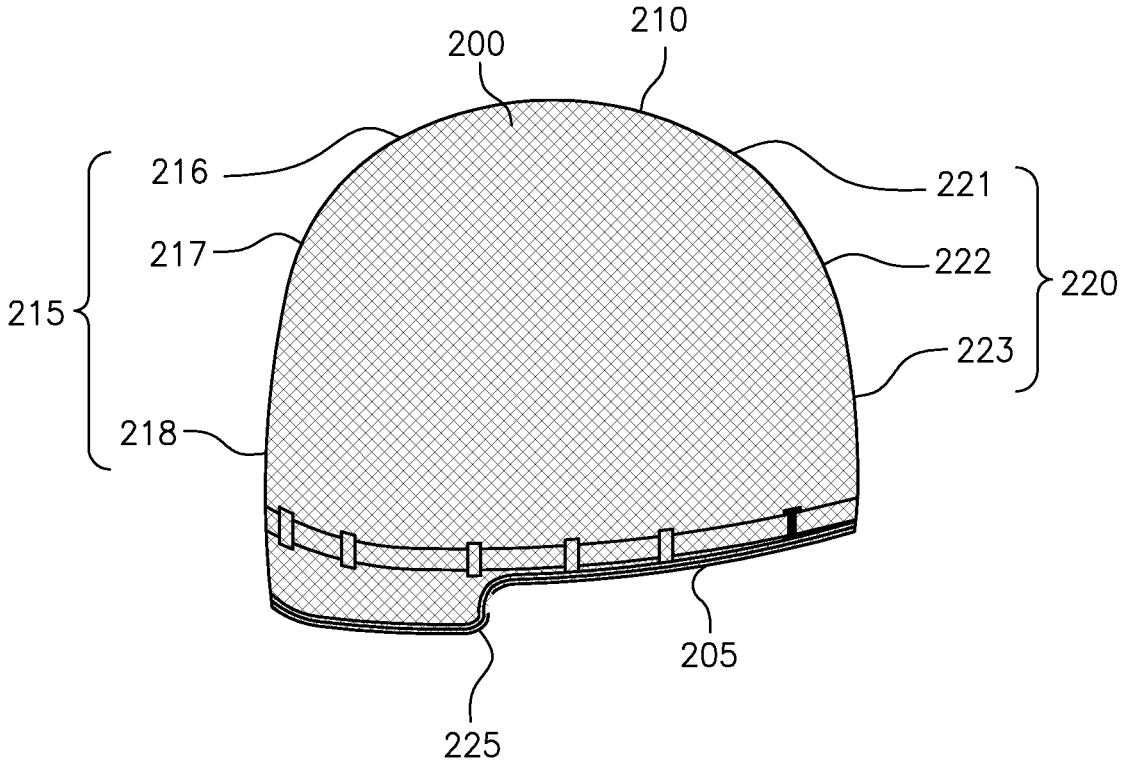
FIGS. 2A-2G illustrate perspective views of a mesh layer of the artificial hair apparatus in accordance with various embodiments of the invention.
Figure 2B:
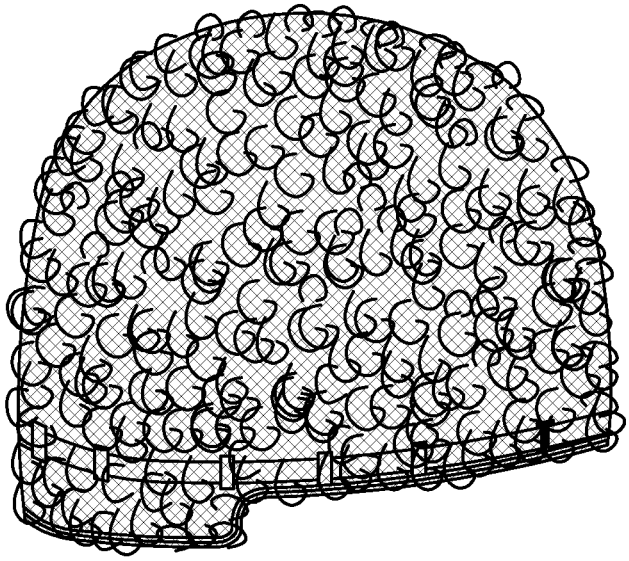

FIGS. 2A and 2B illustrate perspective views of a mesh cap layer 200 of the artificial hair apparatus 100 in accordance with embodiments of the invention. FIG. 2A illustrates the mesh layer 200 and FIG. 2B illustrates the mesh layer 200 including second hair members, as further described herein, covering a surface thereof. The mesh layer 200 is configured to fit around a circumference of a user's head and is the foundation upon which each of the other components of the artificial hair apparatus 100 are attached. The mesh layer 200 is configured as a half-spherical shape, dome shape or other shape that corresponds to the shape of a human head. The mesh layer 200 is constructed out of a flexible material, such as cotton, nylon, or other suitable fabric(s) and blends thereof.

The mesh layer 200 includes an inner surface 205, an outer surface 210, a front region 215, a rear region 220, and a circumferential edge region 225. The circumferential edge region 225 extends around the front region 215 and the rear region 220. The circumferential edge region 225, when worn by a user, lines up with the user's hair line. The front region 215 includes a front top portion 216, a front side portion 217, and a front lower portion 218. The rear region 220 includes a top rear portion 221, a top side portion 222, and a top lower portion 223.

Figure 2C:
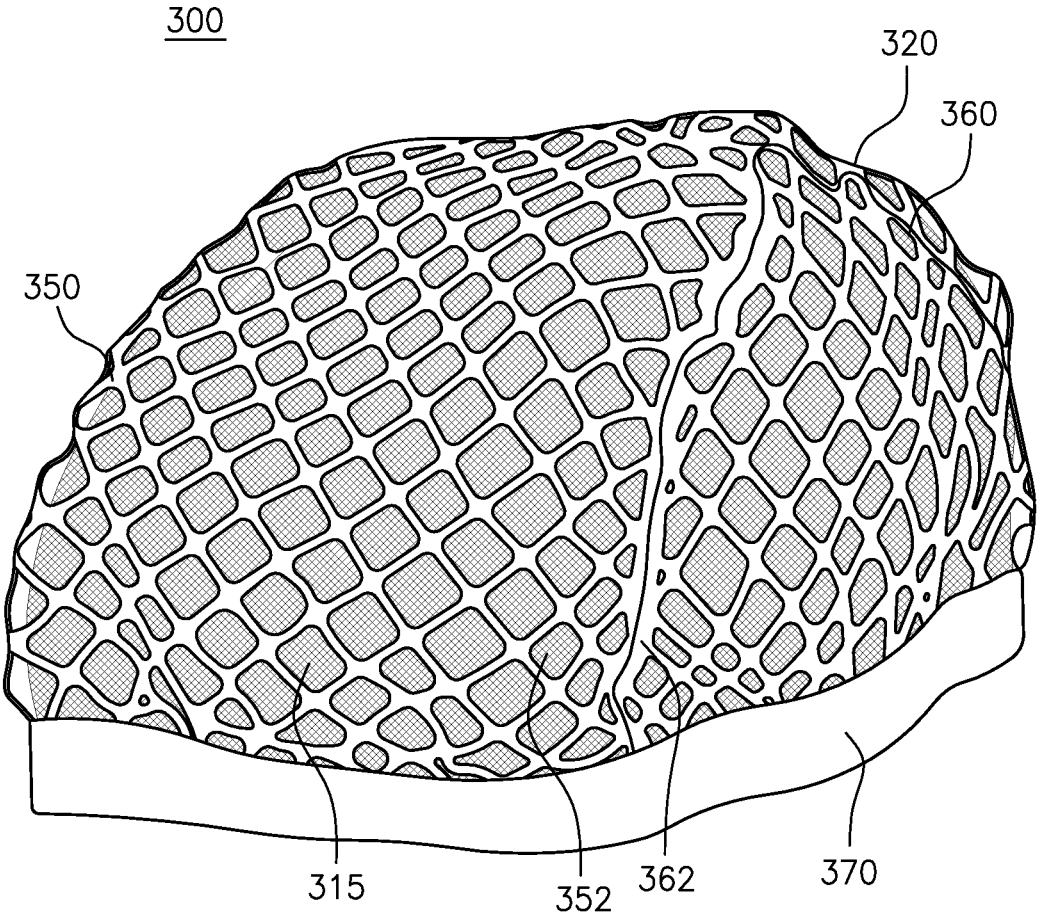

FIG. 2C illustrates a perspective view of the mesh layer 300, in accordance with a further embodiment of the invention. In this embodiment, the mesh layer 300 is constructed of a sufficiently rigid material such that the structure of the mesh layer 300 maintains its shape when placed on a surface. The mesh layer 300 is constructed of a material such that the mesh layer 300 is flexible, but also does not collapse when placed on a surface without any additional supporting structure such as, for example, a mannequin's head or other suitable object. For example, the mesh layer 300 is constructed of synthetic fabric materials, such as polyester, nylon, spandex or other suitable fabric(s) and blends thereof. Other suitable materials may be used so long as such materials provide sufficient rigidity for the mesh layer 300 to maintain the appropriate shape without any additional supporting structure. The thickness of the mesh layer's 300 material, as well as the shape of the holes of the mesh layer 300, also contributes to its collapse-resistant nature. In this embodiment, the user may attach artificial hair to the mesh layer 300 since the mesh layer 300 is maintained at substantially the same shape as the user's head, e.g., a half-spherical shape or dome shape. Thus, the mesh layer 300 maintains a shape such that the user is able to attach the artificial hair to the mesh layer 300 and the positioning of the artificial hair on the mesh layer 300 will not change significantly when the user places the mesh layer 300 on their head.

In the embodiment illustrated in FIG. 2C, the mesh layer 300 includes a center member 350, side members 360 and a band member 370. The center member 350 extends from a front region 315 to a rear region 320. The side members 360 are disposed on opposite sides of the center member 350. The center member 350 is coupled to the side members 360 by, for example, stitching, along seams 362. The seams 362 run along a longitudinal direction of the user's scalp.

The center member 350 includes first apertures 352. The first apertures 352 are configured in a first predetermined width. The first predetermined width may be uniform. That is, the first apertures 352 may be evenly distributed within the center member 350 at equal widths. Alternatively, the first predetermined width may be uneven. That is, the first predetermined width may vary along the surface of the center member 350. Thus, the first predetermined width may include a first predetermined front width corresponding to the front region 315 and a first predetermined rear width corresponding to the rear region 320. The first predetermined front width may be different from the first predetermined rear width. The first predetermined front width may be different from, smaller than, equal to, or larger than the first predetermined rear width. In order for the user to obtain the desired appearance, the first predetermined front width may be smaller than the first predetermined rear width. This is because the first predetermined front width corresponds to the front of the user's head where more styling, parting and variation occurs, as opposed to the first predetermined rear width, which corresponds to the back of the user's hair, where there may be less styling and parting.

According to certain embodiments, the first predetermined width may be 1-10 mm, 2-8 mm, 4-6 mm, or other suitable width. According to further embodiments, the first predetermined width may be 3.5 mm, 4 mm, 4.5 mm, 5 mm, 5.5 mm, 6 mm, 6.5 mm, 7 mm, 7.5 mm, 8 mm, or other suitable width.

Figure 2D:
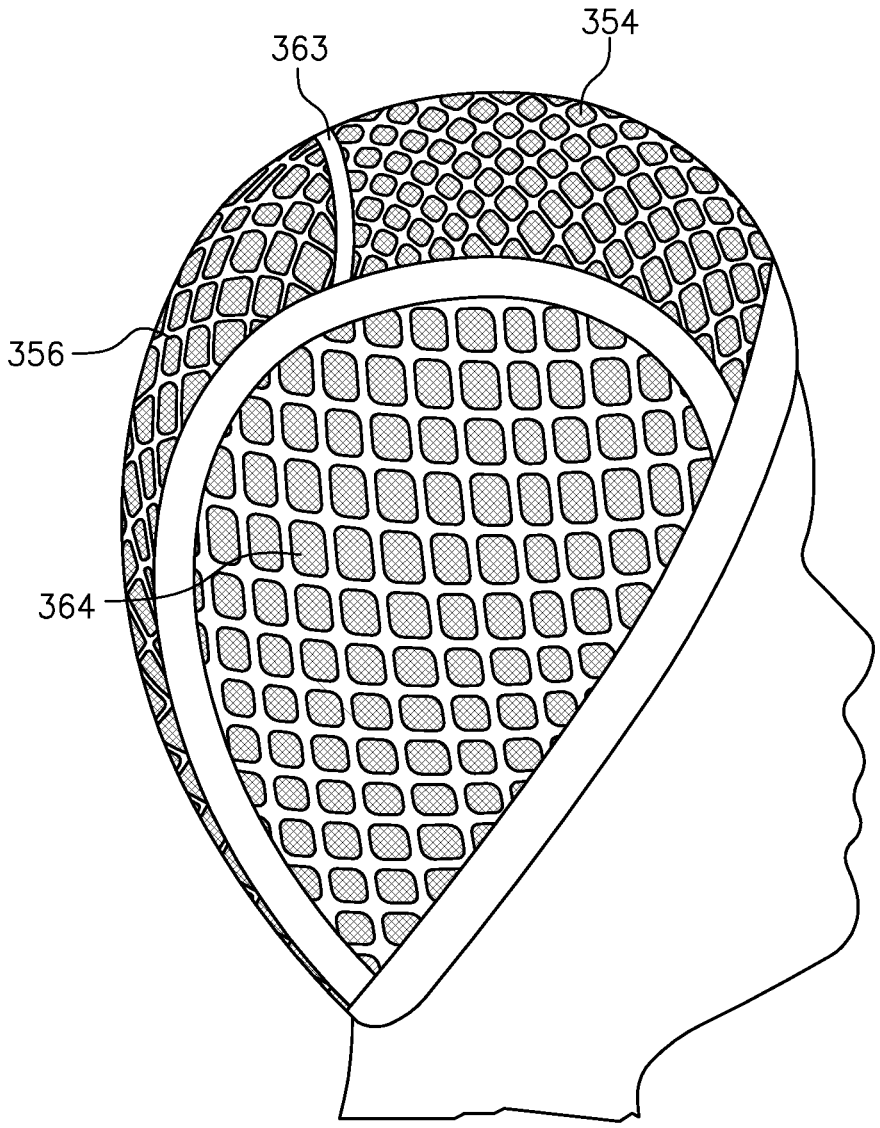

In accordance with another embodiment, as illustrated in FIG. 2D, the center member 350 may include two separate mesh regions coupled together along center seam 363. That is, the center member 350 may include a front center member 354 and a rear center member 356. The center seam 363 is disposed transverse to the seams 362. The apertures 352 in the front center member 354 are configured with a predetermined front center width. The apertures 352 in the rear center member 356 are configured with a predetermined rear center width. The predetermined front center width may be different from, smaller than, equal to, or larger than the predetermined rear center width. In order for the user to obtain the desired appearance, the predetermined front center width may be smaller than the predetermined rear center width. This is because, as described above, the predetermined front center width corresponds to the front of the user's head where more styling, parting and variation occurs as opposed to the first predetermined rear width, which corresponds to the back of the user's hair, where there may be less styling and parting. The predetermined front center width and the predetermined rear center width are sized similar to the first predetermined width, as described above.

The side members 360 include second apertures 364. The second apertures 364 are configured in a second predetermined width. The second predetermined width may be uniform. That is, the second apertures 364 may be evenly distributed within the side members 360 at equal widths. Alternatively, the second predetermined width may be uneven. That is, the second predetermined width may vary along the surface of the side members 360. Furthermore, the first predetermined width may be different from the second predetermined width. The first predetermined front width may be smaller than, equal to, or larger than the second predetermined width.

According to certain embodiments, the second predetermined width may be 1-10 mm, 2-8 mm, 4-6 mm, or other suitable width. According to further embodiments, the second predetermined width may be 3.5 mm, 4 mm, 4.5 mm, 5 mm, 5.5 mm, 6 mm, 6.5 mm, 7 mm, 7.5 mm, 8 mm, or other suitable width.

The band member 370 is configured to fit around a circumference of the user's head. The thickness and/or width of the band member 370 may vary according to the particular application. The band member 370 may be embodied according to various colors to blend with the user's hair and/or skin color. For example, the band member 370 may be any skin tone, e.g., clear, white, beige, brown or black. The band member 370 is coupled to the center member 350 and the side members 360 by, for example, stitching. The band member 370 is constructed of an elastic material that comfortably secures the mesh layer to the user's head. The mesh layer 300 may also be woven, sewn, crocheted, glued, or attached to the user's hair and/or scalp in some other similar manner.

Figure 2E:
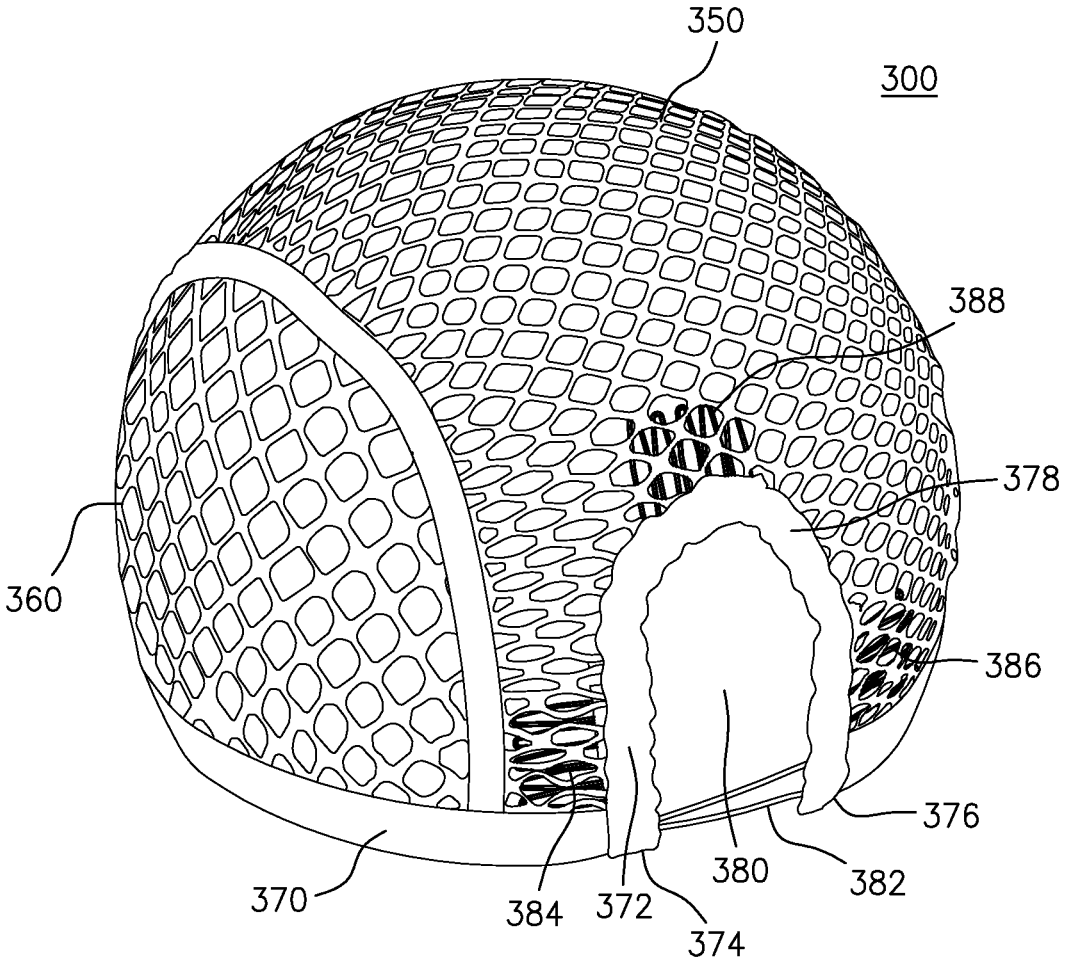

FIG. 2E illustrates a perspective view of the mesh layer 300, in accordance with a further embodiment of the invention. In this embodiment, the mesh layer 300 includes an open parting area 380 and connecting members 382. The band member 370 includes a recessed region 372. The recessed region 372 includes a first lower corner member 374, a second lower corner member 376, an upper member 378, a first lower comb member 384, a second lower comb member 386 and an upper comb member 388. The upper member 378 is disposed between the first lower corner member 374 and the second lower corner member 376 along an edge of the mesh layer 300. The recessed region 372 may be configured as a u-shape, semi-circle, square, rectangle or other suitable shape. The recessed region 372 defines the open parting area 380, allowing the user's natural hair to be pulled through the open parting area 380. The user's natural hair can be blended with the artificial hair coupled to the artificial hair apparatus 100 to provide a natural and aesthetically appealing look. The open parting area 380 may be embodied in various shapes and sizes. For example, the open parting area 380 may be 0.25 inches to 3 inches wide, 1 inch to 2.5 inches wide, or 1 inch wide. For example, the open parting area 380 may be 1 inch to 5 inches deep, 2 inches to 4 inches deep, 3 inches to 3.75 inches wide, or 3.75 inches wide.

The connecting members 382 couple the first lower corner member 374 to the second lower corner member 376. The connecting members 382 are constructed of, for example, thread, elastic string, nylon string, fishing line, or other suitable material. The connecting members 382 are preferably a clear material so that the connecting members 382 are not visible when worn by the user. The connecting members 382 secure the first lower corner member 374 to the second lower corner member 376 so that the edge of the mesh layer 300 remains in place. Furthermore, the connecting members 382 prevent the open parting area 380 from expanding. In an embodiment, the connecting members 382 are removable. The connecting members 382 may be removably coupled to the first lower corner member 374 and the second lower corner member 376 such that the connecting members 382 can be reattached to the first lower corner member 374 and the second lower corner member 376. The connecting members 382 also may be removed by the user by cutting with, for example, scissors.

The first lower comb member 384, the second lower comb member 386 and the upper comb member 388 are coupled to the inner surface of the mesh layer 300. The first lower comb member 384, the second lower comb member 386 and the upper comb member 388 may be metal wire or plastic combs. In an embodiment, the first lower comb member 384, the second lower comb member 386 and the upper comb member 388 include hair clips. The first lower comb member 384, the second lower comb member 386 and the upper comb member 388 include tines that are inserted into the user's natural hair, securing the comb members, and therefore the mesh layer 300, to the user's head. The first lower comb member 384, the second lower comb member 386 and the upper comb member 388 prevent the mesh layer 300 from shifting on the user's head and also keep the mesh layer 300 secured tightly to the user's head. The first lower comb member 384 and the second lower comb member 386 are coupled to the inner surface such that the tines extend in opposite directions, towards each of the side members 360. The tines of the upper comb member 388 extend in a direction perpendicular to the tines of the first lower comb member 384 and the second lower comb member 386, towards the center member 350, away from the open parting area 380.

The positioning of the first lower comb member 384, the second lower comb member 386 and the upper comb member 388, including the location coupled to the mesh layer 300 and the direction of the tines, is of particular importance in the open parting area 380 because the user blends their natural hair with the artificial hair in this location. That is, the first lower comb member 384, the second lower comb member 386 and the upper comb member 388 secure the edge of the recessed region 372 to the user's head. The configuration described herein with respect to FIG. 2E provides the user with the ability to create a natural appearing blend of their natural hair and the artificial hair attached to the artificial hair apparatus 100, while also keeping the artificial hair apparatus 100 secured to the user's scalp.

Figure 2F:
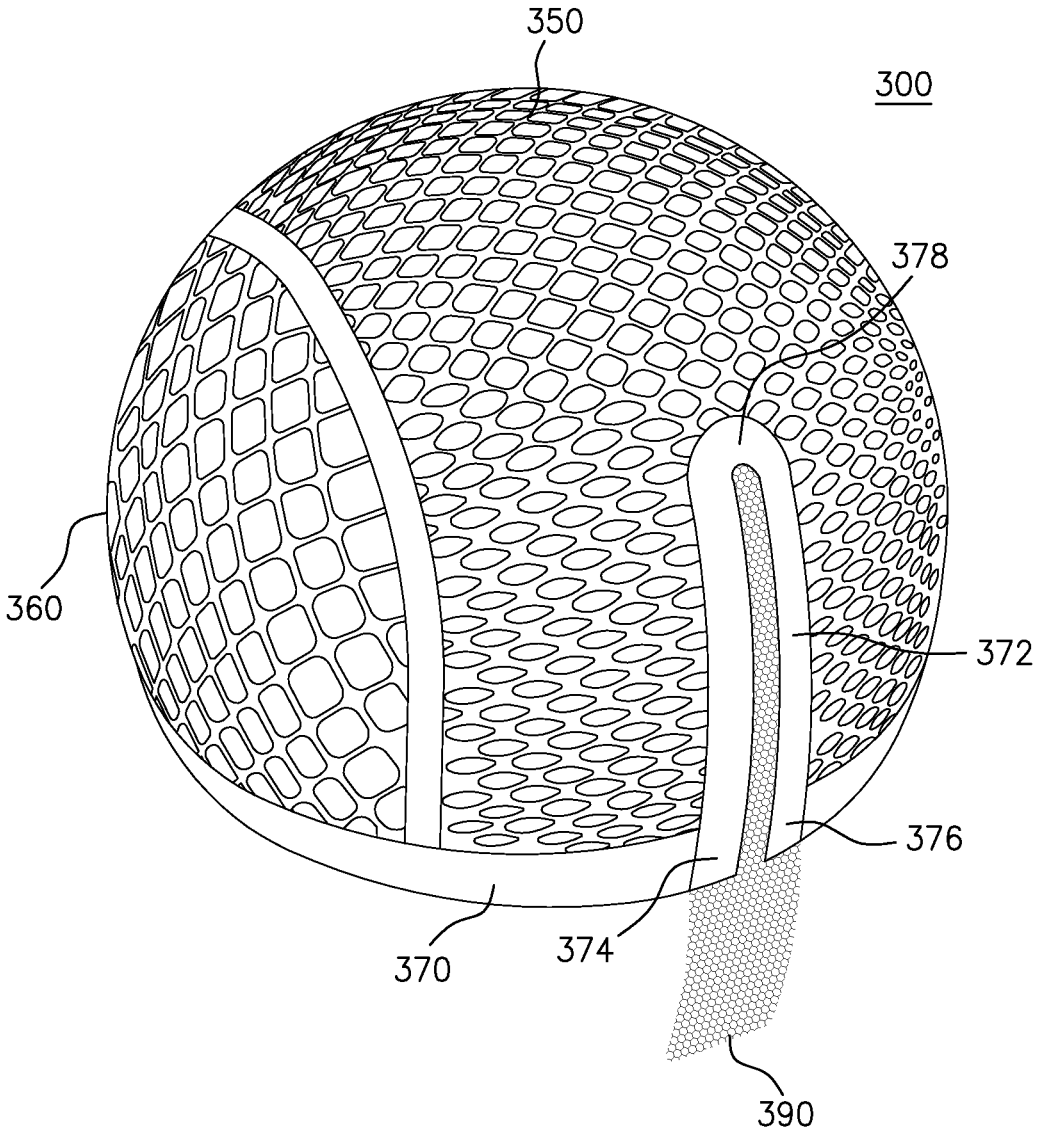
Figure 2G:
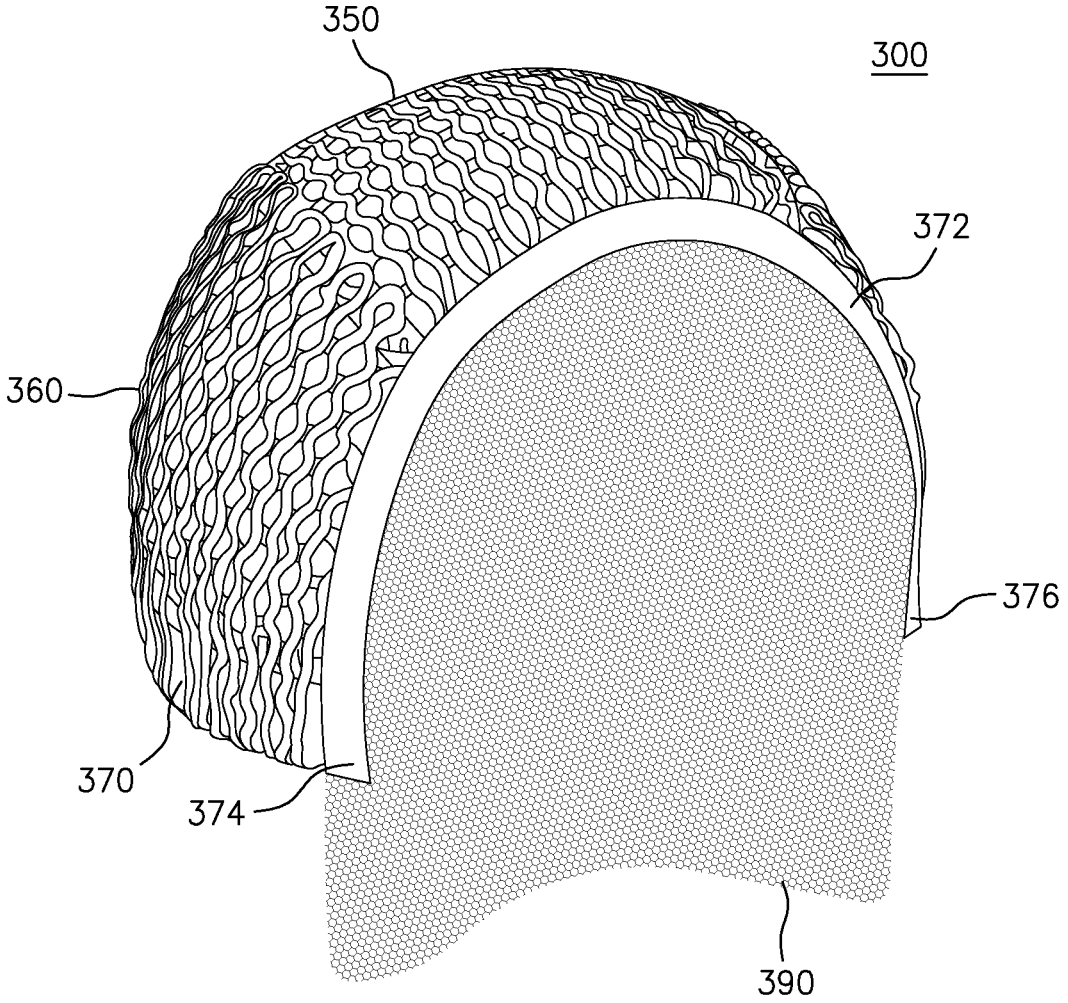

FIGS. 2F and 2G illustrate perspective views of the mesh layer 300, in accordance with further embodiments of the invention. The mesh layer 300 includes a lace mesh member 390. The lace mesh member 390 occupies the recessed region 372. That is, the lace mesh member 390 is disposed in the area between the first lower corner member 374, the second lower corner member 376, and the upper member 378. The lace mesh member 390 is constructed of fine hand-tied nylon, silk, or cotton lace, or other suitable materials and blends thereof. In certain embodiments, at least a portion of the lace mesh member 390 extends beyond the first lower corner member 374 and beyond the second lower corner member 376. The lace mesh member 390 is configured such that artificial hair can be sewn to a surface thereof. In certain embodiments, the lace mesh member 390 does not have artificial hair attached to the surface thereof.

In the embodiment illustrated in FIG. 2F, the lace mesh member 390 is configured as a narrow strip to serve as a region that separates artificial hair coupled to the center member 350. Since the lace mesh member 390 is constructed of fine lace, the lace mesh member 390 illustrated in FIG. 2F has the appearance of a natural hair part.

In the embodiment illustrated in FIG. 2G, the lace mesh member 390 is configured to cover a broad region of the user's scalp. In this embodiment, the lace mesh member 390 extends beyond the center member 350, with the first lower corner member 374 and the second lower corner member 376 disposed within the regions identified as the side members 360.

FIGS. 3A-5 illustrate perspective, front and rear views, respectively, of the artificial hair apparatus 100. The artificial hair apparatus 100 includes a filament 230 coupled to the outer surface 210 of the mesh layer 200. The filament 230 is stitched, glued, stapled or otherwise rigidly coupled to the outer surface 210 of the mesh layer 200. At least a portion of the filament 230 is coupled to the mesh layer at multiple attachment positions in each of the front region 215, the rear region 220, and the circumferential edge region 225 of the mesh layer 200.

The filament 230 is constructed of artificial hair, cotton, nylon, or other suitable material(s) and blends thereof. The filament 230 may be a mono-filament or may include multiple filaments coupled together in a braided pattern or a twisted pattern. The filament 230 may be one continuous piece of material through each of the front region 215, the rear region 220, and the circumferential edge region 225 or multiple separate pieces of material. Thus, the filament 230 may include only a first filament end and a second filament end coupled to the outer surface 210 of the mesh layer 200 or may include more than two filament ends where the filament 230 is constructed of multiple separate pieces of material.

Figure 3A:
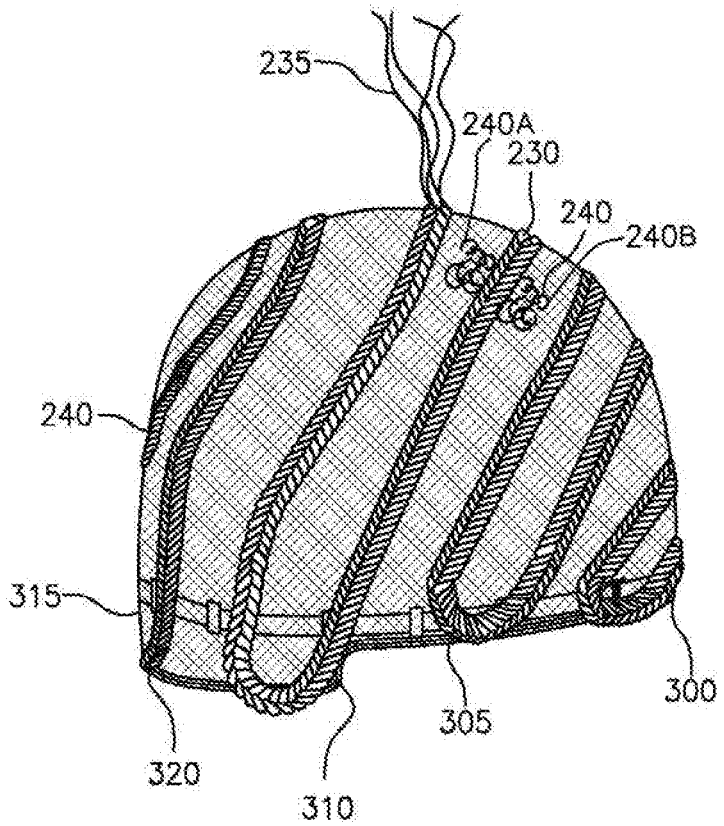
FIGS. 3A-3B illustrate a side view of the artificial hair apparatus with long and short hair partially removed with the filament coupled to the mesh layer in a transverse direction and a longitudinal direction, respectively.
Figure 3B:
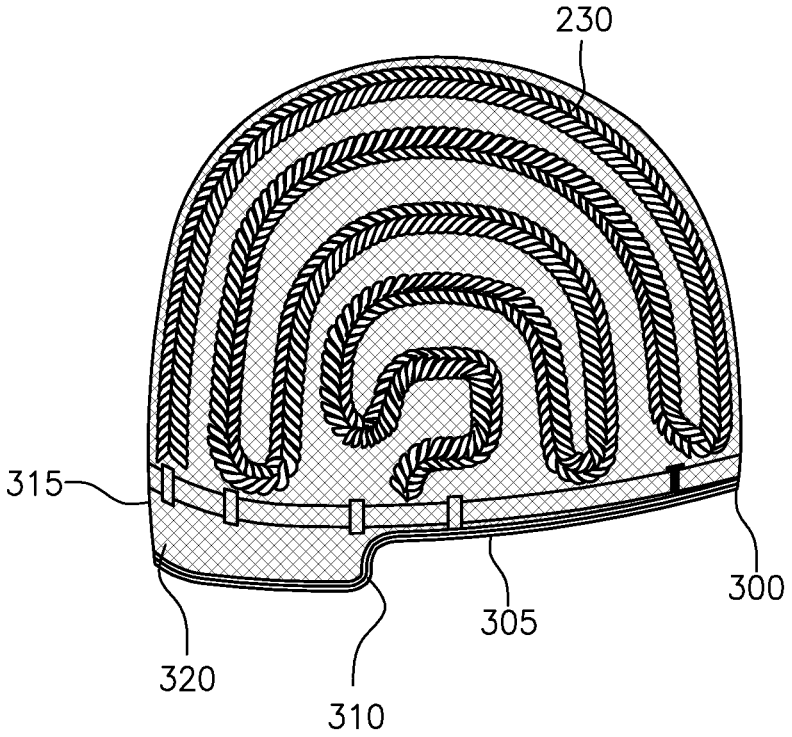

Multiple first hair members 235 are coupled to the filament 230. FIGS. 3A-3B illustrate a side view of the artificial hair apparatus 100 with long and short hair partially removed with the filament 230 coupled to the mesh layer 200 in a transverse direction and a longitudinal direction, respectively. In FIGS. 3A-3B, the first hair members 235 are illustrated as being coupled to only a portion of the filament 230 for illustrative purposes. Generally, a sufficient number of the first hair members 235 are coupled to the filament 230 to cover the entire artificial hair apparatus 100, as illustrated in FIG. 1. The first hair members 235 are constructed of artificial hair and include braided, curled, crimped, wavy or straight hair textures and combinations thereof. The first hair members 235 are sewn, braided, wrapped around, or otherwise coupled to the filament 230.

The first hair members 235 are distributed at a first predetermined spacing along the filament 230 in the rear region 220, at a second predetermined spacing along the filament 230 in the front region 215, and at a third predetermined spacing along the filament 230 in the circumferential edge region 225. The first predetermined spacing, the second predetermined spacing, and the third predetermined spacing may be greater in distance, equal in distance, or less in distance, than each other spacing. Thus, the density of first hair members 235 disposed in the front region 215 may be greater than, equal to, or less than, the density of the first hair members 235 disposed in the rear region 220. The density of first hair members 235 disposed in the front region 215 may be greater than, equal to, or less than, the density of the first hair members 235 disposed in the circumferential edge region 225. The density of first hair members 235 disposed in the rear region 220 may be greater than, equal to, or less than, the density of the first hair members 235 disposed in the circumferential edge region 225.

Furthermore, the first predetermined spacing may vary to include multiple different spacings within the rear region 220. The second predetermined spacing may vary to include multiple different spacings within the front region 215. The third predetermined spacing may also vary to include multiple different spacings within the circumferential edge region 225. Varying the first predetermined spacing, the second predetermined spacing, and the third predetermined spacing within the rear region 220, the front region 215, and the circumferential edge region 225, respectively, allows the first hair members 235 to be configured according to various hair styles and to provide a natural and fashionable appearance.

Multiple second hair members 240 are disposed between the filament 230 and the mesh layer 200. The second hair members 240 are slidably or rigidly disposed between the filament 230 and the mesh layer 200. The second hair members 240 are crocheted between the filament 230 and the mesh layer 200 by hand crocheting or by machine crocheting. The second hair members 240 may be crocheted directly to the filament 230. The second hair members 240 are constructed of artificial hair and are braided, curled, crimped or straight and also may not be completely straight hair.

The second hair members 240 fill in spaces not occupied by the first hair members 235, concealing the mesh layer 200 and providing a more natural appearance. The second hair members 240 may be slid to either side of the filament 230 in order to adjust their positioning to serve the above-described purpose of concealing the mesh layer 200. If a user of the artificial hair apparatus 100 were to part the first hair members 235, the second hair members 240 are adjusted to fill in the spacing within such part and conceal the mesh layer 200.

The first hair members 235 are generally a different length than the second hair members 240. The first hair members 235 are a first length and the second hair members 240 are a second length. The first length may be greater than the second length. The first length may be at least one and a half times, one and three quarters times, two times, five times, or ten times, greater in length than the second length. The first length and the second length are measured when the first hair members 235 and the second hair members 240 are fully extended.

For example, where either the first hair members 235 or the second hair members 240 are crimped, the first length and second length are measured when the first hair members 235 and the second hair members 240 are fully extended to remove any such crimping, thus being in a straight configuration. The first hair members 235 and the second hair members 240 are not directly coupled to each other. That is, the first hair members 235 and the second hair members 240 may be in contact with one another, but they are not attached to one another and are not one continuous piece of artificial hair. The second hair members 240 include a first end 240A and a second end 240B. The first end 240A and the second end 240B of the second hair members 240 are disposed on opposite sides of the filament 230 or on the same side of the filament 230 when the second hair members 240 are disposed between the filament 230 and the mesh layer 200.

The circumferential edge region 225 includes a rear edge portion 300, a side edge portion 305, a temple edge portion 310, and a front edge portion 315. The rear edge portion 300 and the front edge portion 315 are constructed of a substantially inelastic material. That is, the rear edge portion 300 and the front edge portion 315 are constructed of a flexible material that is flexible and somewhat elastic, but that is not made of an elastic-type material. The side edge portion 305 and the temple edge portion 310 are substantially elastic. The side edge portion 305 and the temple edge portion 310 are constructed of an elastic material. The temple edge portion 310 of the circumferential edge region 225 is contoured to correspond to a user's hairline.

Multiple third hair members 320 are coupled directly to the circumferential edge region 225. The third hair members 320 are coupled to each of the rear edge portion 300, the side edge portion 305, the temple edge portion 310, and the front edge portion 315. The third hair members 320 include curly, straight, crimped, and wavy hair textures and combinations thereof.

In an embodiment, there is no temple edge portion 310 protruding from the circumferential edge region 225. In this embodiment, the circumferential edge region 225 extends linearly around the circumference of the user's scalp. With the circumferential edge region 225 configured to be linear, the artificial hair apparatus 100 can be moved from side to side, that is, closer from one of the user's ears or to the opposite ear. Thus, the user is able to adjust the direction, by rotating the artificial hair apparatus 100, and positioning, by moving the artificial hair apparatus from side to side, of a part in the first hair members 235. If the temple edge portion 310 were present, the user would not be able to move the artificial hair apparatus 100 in this manner since the temple edge portion 310 would otherwise overlap too much of the user's ear, if moved to the side, or overlap the user's forehead, if rotated.

Figure 4:
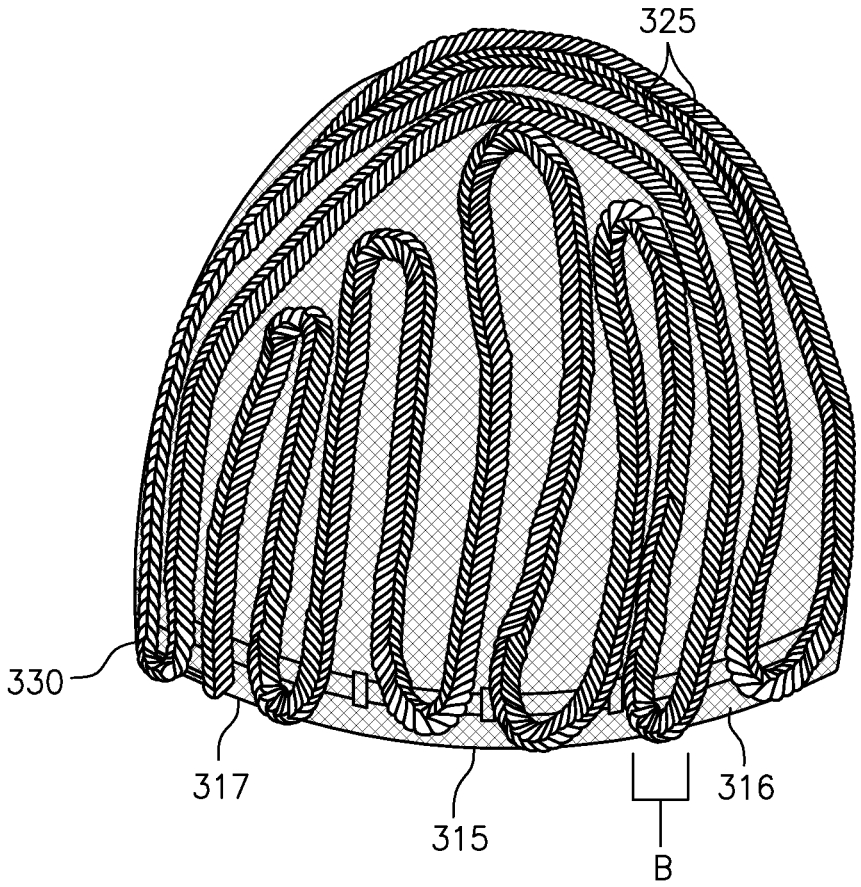
FIG. 4 illustrates a front view of the artificial hair apparatus with long and short hair removed.
Figure 5:
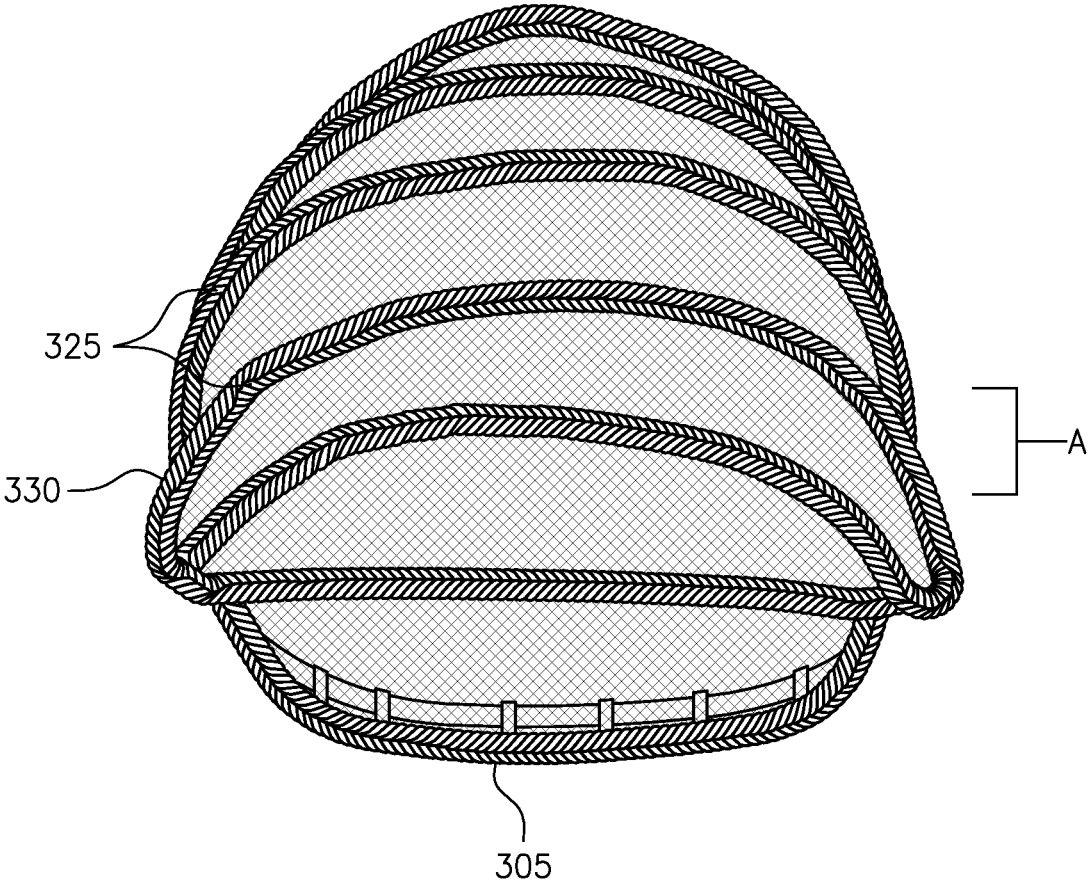
FIG. 5 illustrates a rear view of the artificial hair apparatus with long and short hair removed.

In FIGS. 4 and 5, the first hair members 235 and the second hair members 240 have been removed for illustrative purposes. Referring to FIGS. 4 and 5, the side edge portion 305 of the circumferential edge region 225 includes a first side edge and a second side edge, that is, sides corresponding to a user's left ear and right ear, respectively, when the artificial hair apparatus 100 is viewed from the front. The filament 230 is coupled to the rear region 220 of the mesh layer 200 from substantially the first edge of the side edge portion 305 in a serpentine manner across the mesh layer 200 to the second edge. The filament 230 may also be coupled to the rear region 220 of the mesh layer 200 according to additional alternative configurations, as further described herein with respect to FIGS. 9A-9F. The filament 230 is coupled to the rear region 220 of the mesh layer 200 in either a transverse direction or a longitudinal direction across the mesh layer 200. The transverse direction is perpendicular to the longitudinal direction. The orientation, either transverse or longitudinal, of the filament 230 is determined based on the alignment of the longest straight length of the filament 230.

The front edge portion 315 of the circumferential edge region 225 includes a first front end edge 316 and a second front end edge 317. The first front end edge 316 is on an opposite end of the front edge portion 315 to the second front end edge 317. The filament 230 is coupled to the front region 215 of the mesh layer 220 from substantially the first front end edge 316 across the mesh layer 200 in a serpentine manner to the second front end edge 317. The filament 230 is coupled to the front region 215 of the mesh layer 220 in either the transverse direction or the longitudinal direction across the mesh layer 200.

The filament 230 is disposed on the outer surface 210 of the mesh layer 200 in a plurality of rows 325. At least one end of each of the second hair members 240 is disposed between each of the rows 325 of the filament 230 on the outer surface 210 of the mesh layer 200. The rows 325 of the filament 230 are disposed on the outer surface 210 of the mesh layer 200 at a first distance A between each row in the rear region 220 and at a second distance B between each row in the front region 215. The first distance A may be greater than, equal to, or less than the second distance B.

In an embodiment, the first distance A is greater than the second distance B in order to provide a higher density of artificial hair in the front region 215 than in the rear region 220. A higher density of artificial hair is needed in the front region 215 because the front region 215 is where users tend to part their hair and the higher density of hair provides a more natural appearance.

The first distance A may vary within the rear region 220 and the second distance B may vary within the front region 215 according to a desired style. For example, the first distance A may taper as the rows 325 of the filament 230 approach the curved regions 330. Thus, the first distance A may be greater, on average, than the second distance B, even though at certain positions the first distance A and the second distance B are approximately equal, such as when the rows 325 of the filament 230 are directly adjacent to each other.

As described above, the filament 230 is coupled to the rear region 220 and the front region 215 of the mesh layer 200 in a serpentine manner. The filament 230 includes curved regions 330 disposed along the outer surface 210 of the mesh layer 200 where the filament 230 turns to form the next row 325. It is noted that reference to the filament 230 turning to form the next row 325 indicates the structure of the filament 230. That is, the filament 230 includes multiple sections and at least one of those sections is curved. The curved regions 330 are disposed at the circumferential edge 225 in the rear region 220. The curved regions 330 may also be disposed above the circumferential edge 225 on the rear lower portion 223 of the rear region 220. The curved regions 330 may be disposed at the circumferential edge 225 and the top front portion 216 of the front region 215. The curved regions 330 may be disposed above the circumferential edge 225 at the lower front region 218 and the top front portion 216 of the front region 215. In an embodiment, the curved regions 330 of the filament 230 are attached to the entire circumference of the circumferential edge 225 with gaps between each row 325.

Figure 6:
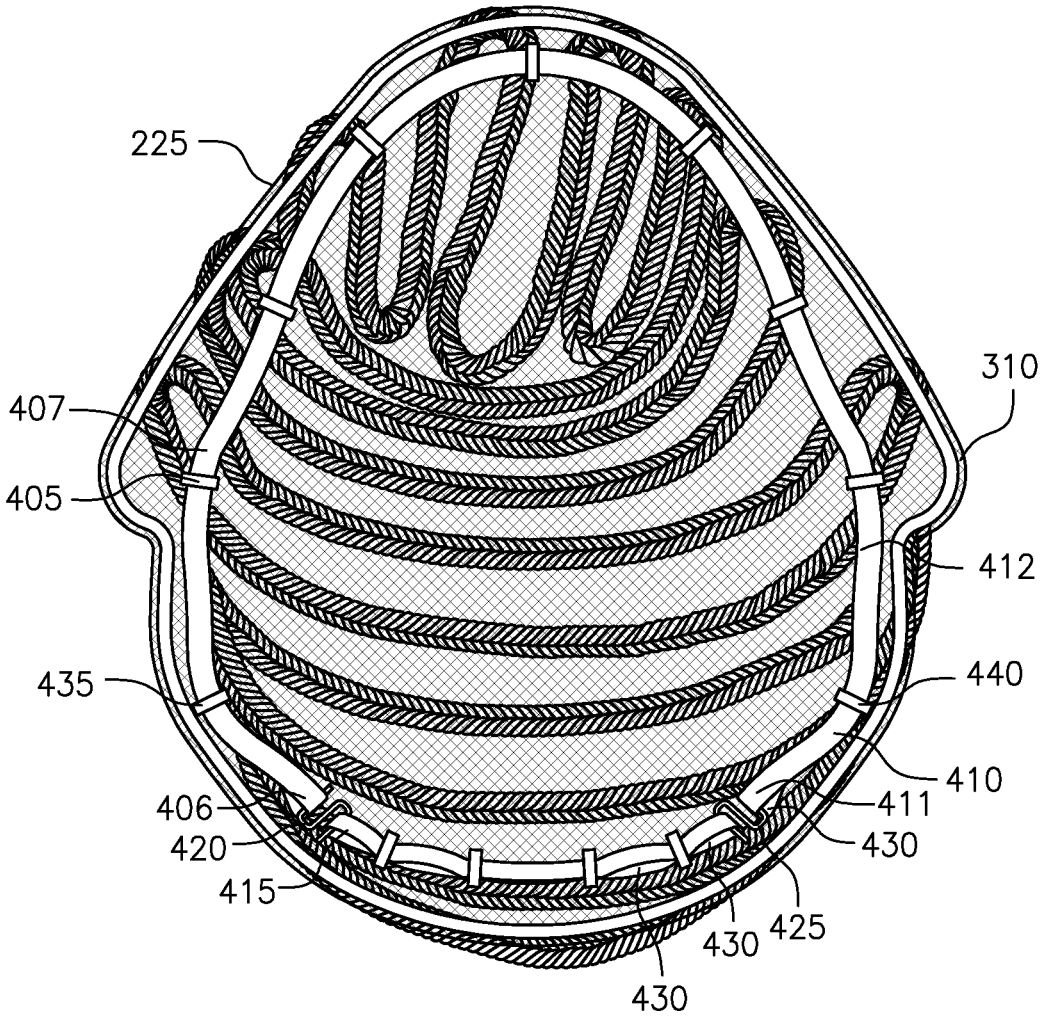
FIG. 6 illustrates a bottom view of an inner surface of the artificial hair apparatus.

FIG. 6 illustrates a bottom view of the inner surface 205 of the artificial hair apparatus 100. The artificial hair apparatus 100 includes a first adjustment member 405, a second adjustment member 410, and an adjustment hook receiving member 415. The first adjustment member 405 includes a first adjustment hook 420, a first alignment loop 435, a distal end 406 and a proximal end 407. The first adjustment member 405 is constructed of a flexible elastic material. The first adjustment hook 420 is coupled to the distal end 406 of the first adjustment member 405. The first adjustment member 405 extends along an interior surface of the circumferential edge 225. The proximal end 407 of the first adjustment member 405 is coupled to the temple edge portion 310. The first adjustment member 405 is rigidly secured to the temple edge portion 310 by, for example, stitching. The first alignment loop 435 is coupled to the side edge portion 305 and maintains alignment of the first adjustment member 405 along the circumferential edge 225 such that the first adjustment member 405 does not shift away from the circumferential edge 225.

The second adjustment member 410 includes a second adjustment hook 425, a second alignment loop 440, a distal end 411 and a proximal end 412. The second adjustment member 410 is constructed of a flexible elastic material. The second adjustment hook 425 is coupled to the distal end 411 of the second adjustment member 410. The second adjustment member 410 extends along the interior surface of the circumferential edge 225 on an opposite side of the artificial hair apparatus 100 to the first adjustment member 405. The proximal end 412 of the first adjustment member 405 is coupled to the temple edge portion 310. The second adjustment member 410 is rigidly secured to the temple edge portion 310 by, for example, stitching. The second alignment loop 440 is coupled to the side edge portion 305 and maintains alignment of the second adjustment member 410 along the circumferential edge 225 such that the second adjustment member 410 does not shift away from the circumferential edge 225.

The adjustment hook receiving member 415 includes multiple hook receiving loops 430. The adjustment hook receiving member 415 extends along the interior surface of the circumferential edge 225 at the rear edge portion 305. The adjustment hook receiving member 415 is constructed of a flexible inelastic material. In order to adjust the fit of the artificial hair apparatus 100, a user inserts the first adjustment hook 420 and the second adjustment hook 425 into the appropriate hook receiving loop 430. The circumferential edge 225 thus may be contracted or expanded to correspond to the circumference of the user's head, providing a comfortable and secure fit.

Where the first adjustment member 405 and the second adjustment member 410 are fixedly secured to the temple edge portion 310, the first adjustment member 405 and the second adjustment member 410 are elastically adjustable with respect to the side edge portion 310 and the rear edge portion 300 and elastically non-adjustable with respect to the temple edge portion 310. The temple edge portion 310 thus remains elastic and flexible, but does not expand and contract depending on insertion of the first adjustment hook 420 and the second adjustment hook 425 within any particular hook receiving loop 430. This allows the temple edge portion 310 to retain the proper and comfortable positioning on the user's head for a natural appearance.

A method of manufacturing each embodiment of the artificial hair apparatus 100 described herein is also provided. For example, the method of manufacturing the artificial hair apparatus 100 described herein may be implemented using the embodiments of either the mesh layer 200 or the mesh layer 300 and their respective components. The method includes coupling the filament 230 to the outer surface 210 of the mesh layer 200. At least a portion of the filament 230 is coupled to each of the front region 215, the rear region 220 and on the circumferential edge region 225 of the mesh layer 200. The first hair members 235 are coupled to the filament 230.

The second hair members 240 are crocheted between the filament 230 and the mesh layer 200. The second hair members 240 are crocheted between the filament 230 and the mesh layer 200 by hand or by a crocheting machine. The second hair members 240 are crocheted according to any basic crochet stitch, including the chain stitch, the slip stitch, the single crochet stitch, the half double crochet stitch, and the double crochet stitch, as well as any advanced type of crochet stitch, including the shell stitch, the V stitch, the spike stitch, the Afghan stitch, the butterfly stitch, the popcorn stitch, and the crocodile stitch, and combinations thereof. The second hair members 240 may be crocheted directly to the filament 230 or directly to the mesh layer 200. Furthermore, the second hair members 240 may be crocheted directly to both the filament 230 and directly to the mesh layer 200.

According to the embodiments described with respect to FIGS. 2A-2D, and including the variations described in each of the other embodiments disclosed herein, the artificial wig apparatus 100 may be sold as part of a kit for assembling the artificial wig 100. The kit includes the mesh layer 200, the filament 230, and artificial hair. The kit further includes thread and a crochet hook. The kit may be sold in, for example, cardboard packaging wrapped in plastic cellophane or other suitable packaging appropriate for display on store shelves. In the kit, the components of the artificial wig apparatus 100 may not be coupled together. That is, the filament 230 may not be coupled to the mesh layer 200 and the artificial hair may not be coupled to the mesh layer 200 or to the filament 230. The kit allows the user to easily attach the filament 230 and the artificial hair to the mesh cap customized to their own preferences and personal style. According to further embodiments, a method of assembling the kit is provided that includes providing each of the components of the artificial wig apparatus 100 described herein, along with a crochet hook and thread, and inserting such components into a package.

Figure 7:
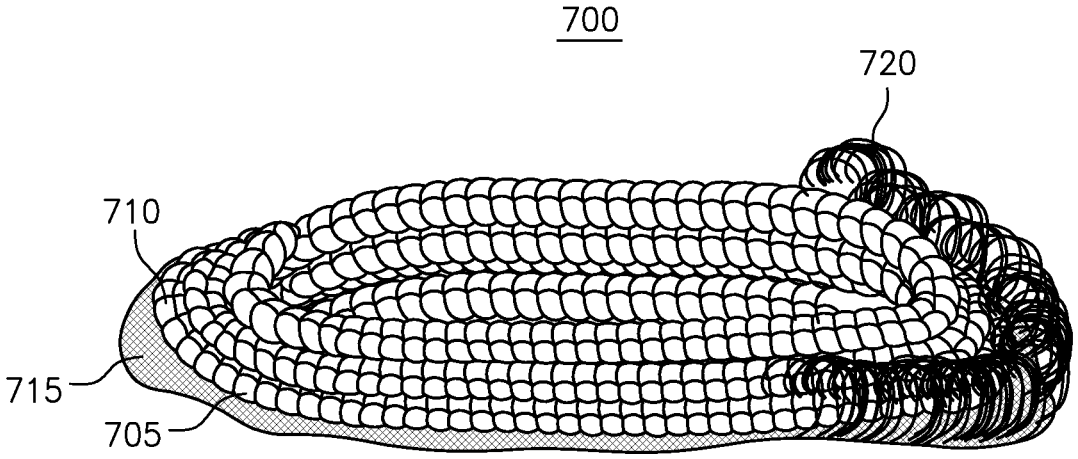
FIGS. 7 and 8 illustrate the artificial hair apparatus configured to cover a portion of the user's scalp.
Figure 8:
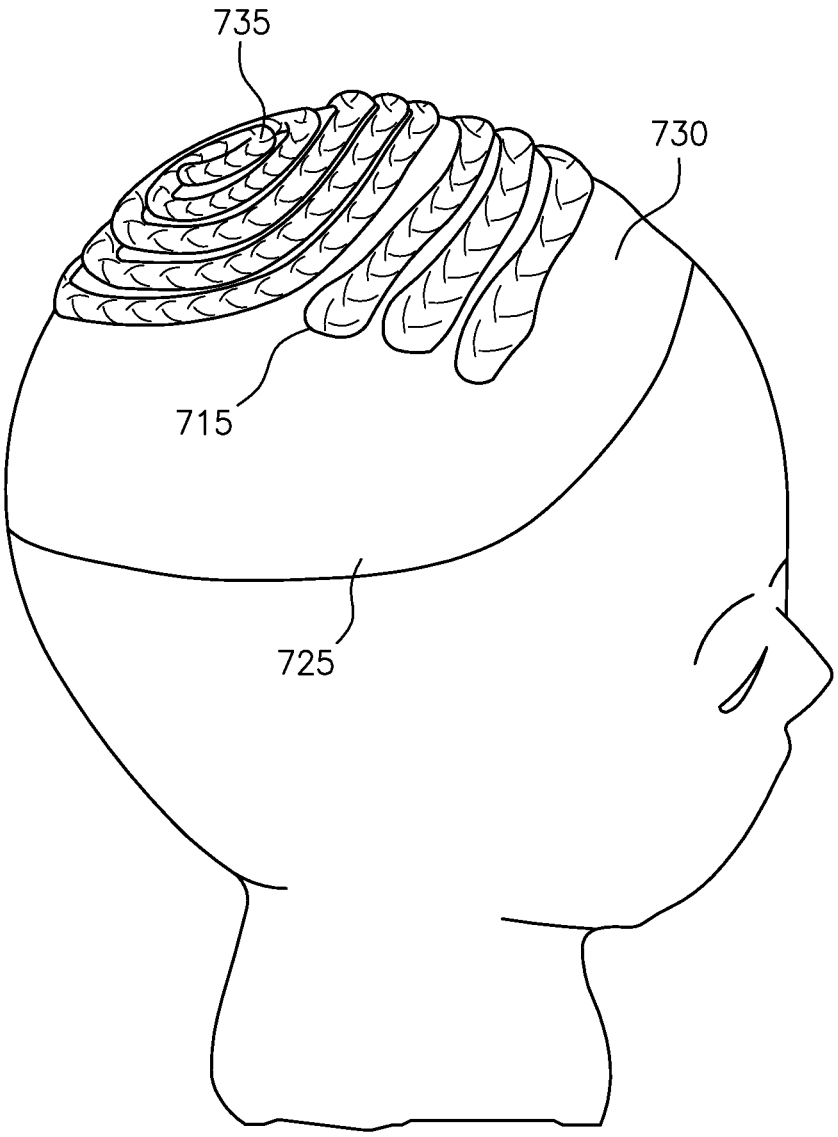

FIGS. 7 and 8 illustrate the artificial hair apparatus 100 embodied as a partial artificial hair apparatus 700 according to further embodiments of the invention. The partial artificial hair apparatus 700 is configured to cover a portion of the user's head. The partial artificial hair apparatus 700 is useful for people that have partial balding or thinning of a portion of the natural hair on their scalp. The partial artificial hair apparatus 700 provides a wig that covers bald spots and/or areas of thinning hair, but does not cover the user's entire head. The partial artificial hair apparatus 700 may also be used to provide a user with a portion of artificial hair having a color that, for example, contrasts with the user's natural hair. Thus, the partial artificial hair apparatus 700 may be used by a user whether or not they have bald spots and/or areas of thinning hair in order to add a streak of color to their natural hair.

The partial artificial hair apparatus 700 is configured similarly as described herein in regards to the front region 215. However, the partial artificial hair apparatus 700 does not extend around the circumference of the user's scalp in the same manner as the artificial hair apparatus 100. The partial artificial hair apparatus 700 includes a perimeter edge 705, a filament 710, and a mesh layer 715. The perimeter edge 705 includes fringe hair 720 coupled thereto. The fringe hair 720 may be coupled around the entire perimeter edge 705 or the fringe hair 720 may be coupled around a portion of the perimeter edge 705. The fringe hair 720 includes curly, straight, crimped, and wavy hair textures and combinations thereof. The fringe hair 720 may be stitched, glued, stapled, or otherwise rigidly secured to the perimeter edge 705. In an embodiment, the fringe hair 720 is not included with the partial artificial hair apparatus 700.

The filament 710 may be stitched, glued, stapled, or otherwise rigidly secured to the mesh layer 715. The filament 710 may be coupled to the mesh layer in a corn row, crown part, diagonal part, side bang part, side part and center part manner or other suitable configurations.

According to an embodiment of the invention, the mesh layer 715 may extend up to the outermost row of the filament 710, whereas in other embodiments the mesh layer 715 may extend beyond the outermost row of the filament 710. As illustrated in FIG. 8, the mesh layer 715 includes temple regions 725, a forehead region 730, and a top region 735. The temple regions 725 of the mesh layer 715 correspond to approximately the temple area of the user's scalp. The forehead region 730 corresponds to the user's hairline. The top region 735 corresponds to the top of the user's scalp.

In use, the mesh layer 715 may be woven, stitched, crocheted, glued, or attached to the user's hair and/or scalp in some other similar manner. That is, since the partial artificial hair apparatus 700 does not extend around the circumference of the user's scalp in the same manner as the artificial hair apparatus 100, the partial artificial hair apparatus 700 is secured to the user's scalp by the above methods. For example, with the user's hair braided in a corn row style, the mesh layer 715 is woven to the user's corn row with thread, thus securing the partial artificial hair apparatus 700 to the user's scalp. Alternatively, the mesh layer 715 may be crocheted to the user's scalp by pulling the user's natural hair through the mesh layer 715.

Furthermore, the mesh layer 715 can be cut with, for example, scissors, to be customized to the individual user's hairline. That is, the mesh layer 715 is sold in a size that would extend beyond the user's natural hairline. The mesh layer 715 is thereafter cut to a size that ends before the edge of the user's hairline. The mesh layer 715 therefore secures the partial artificial hair apparatus 700 to the user's scalp, but is concealed by the user's natural hair.

Figure 9A:
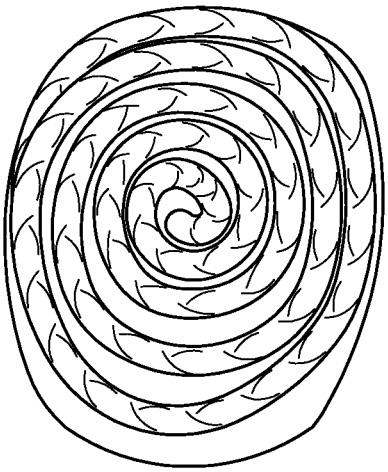
FIGS. 9A-9F illustrate various embodiments of the manner in which the filament extends across the mesh layer.
Figure 9B:
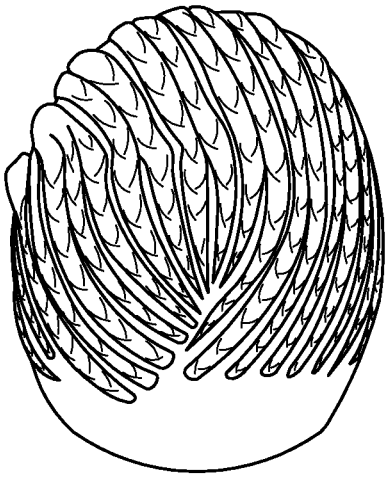
Figure 9C:
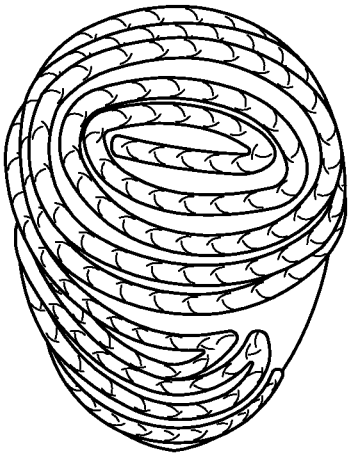
Figure 9D:
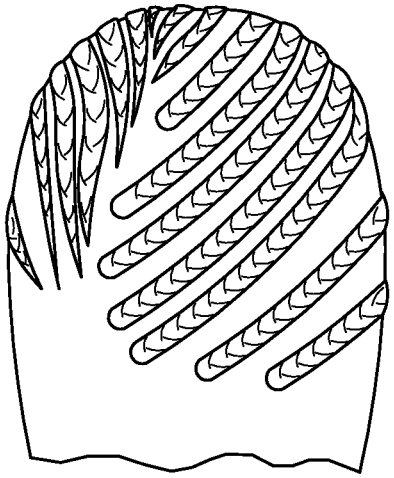
Figure 9E:
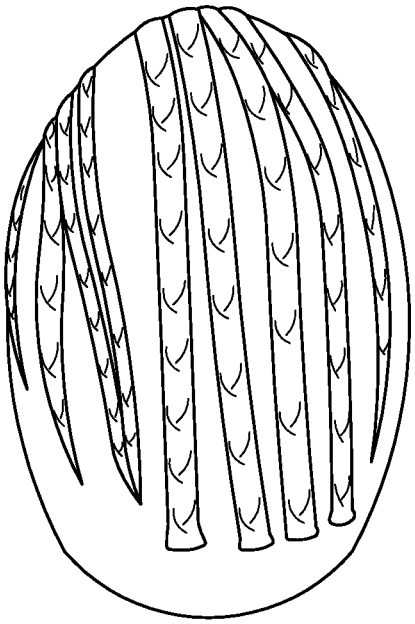
Figure 9F:
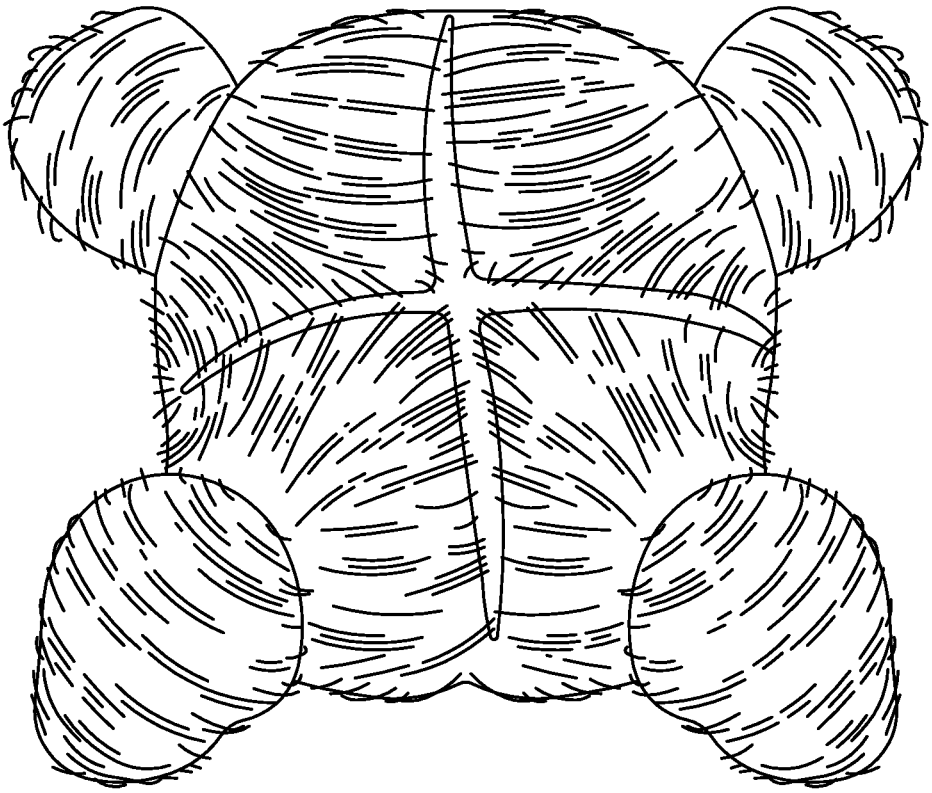

FIGS. 9A-9F illustrate various embodiments of the manner in which the filament 230 extends across the mesh layer 200. That is, the filament 230 may extend across the mesh layer from substantially the first edge of the side edge portion 305 in a crown part, as illustrated in FIG. 9A, diagonal part, as illustrated in FIG. 9B, side bang part, as illustrated in FIG. 9C, side part as illustrated in FIG. 9D, center part, as illustrated in FIG. 9E, and a quadrant part, as illustrated in FIG. 9F, manner across the mesh layer 200 to the second edge. In FIGS. 9A-9F, the filament 230 is illustrated as being braided, however, the filament 230 may be straight, twisted or other suitable configuration.

The embodiments described herein include wig apparatuses, methods of manufacturing wigs, kits for assembling wigs, methods of assembling kits for wigs, and packaging for wigs and wig kits that include certain advantages over conventional wigs. Each of the features of the embodiments described herein may be combined with any other embodiment whether or not expressly stated.

In particular, the embodiments described herein provide a wig configured to include artificial hair of varying lengths that it is adjustable, which allows a user of the wig to customize the wig to their own preferences. The wig further includes elastic and inelastic regions that allow the wig to retain proper and comfortable positioning on the user's head for a natural appearance and comfortable fit. Furthermore, the wig includes a mesh cap layer that maintains and is also sufficiently rigid so that it does not collapse when placed on a surface without any additional supporting structure such as, for example, a mannequin's head or other suitable object. Thus, the user may easily attach artificial hair to the mesh cap without the need for additional supporting structure.

While embodiments of the invention have been shown and described with reference to certain embodiments thereof, it will be understood by those skilled in the art that various changes in form and details may be made therein without departing from the spirit and scope of the invention as defined by the appended claims and equivalents thereof.

What is claimed is:

1. An artificial hair apparatus comprising:

a mesh layer configured to fit around a circumference of a user's head comprising an inner surface, an outer surface, a front region, a rear region, and a circumferential edge region that extends around the front region and the rear region;

a filament coupled to the outer surface of the mesh layer, at least a portion of the filament being disposed in each of the front region, the rear region and on the circumferential edge region of the mesh layer;

a plurality of first hair members coupled to the filament; and a plurality of second hair members slidably disposed between the filament and the mesh layer, the second hair members comprising a first end and a second end, the first hair members comprising a first length and the second hair members comprising a second length, the first length being greater than the second length, wherein the first end and the second end of the second hair members are disposed on the outer surface of the mesh layer.

2. The apparatus according to claim 1, wherein the circumferential edge region comprises a rear edge portion, a side edge portion, a temple edge portion, and a front edge portion, and wherein the rear edge portion and the front edge portion are substantially inelastic and the side edge portion and the temple edge portion are substantially elastic.

3. The apparatus according to claim 1, wherein the circumferential edge region comprises a side edge portion comprising a first side edge and a second side edge, and wherein the filament is coupled to the rear region of the mesh layer from substantially the first edge across the mesh layer in a transverse direction to the second side edge.

4. The apparatus according to claim 1, wherein the filament is disposed on the mesh layer in a plurality of rows across the mesh layer, and wherein the first end and the second end of the second hair members are disposed between each of the rows of the filament on the outer surface of the mesh layer.

5. The apparatus according to claim 4, wherein the rows of filament comprise a first distance between each row in the rear region and a second distance between each row in the front region, and wherein the first distance is greater than the second distance.

6. The apparatus according to claim 1, wherein the circumferential edge region comprises a front edge portion comprising a first front end edge and a second front end edge, and wherein the filament is coupled to the front region of the mesh layer from substantially the first front end edge across the mesh layer in a serpentine manner perpendicular to the transverse direction to substantially the second front end edge.

7. The apparatus according to claim 1, wherein the filament is coupled to the rear region and the front region of the mesh layer in a substantially serpentine manner.

8. The apparatus according to claim 1, wherein the first hair members are distributed at a first predetermined spacing along the filament in the rear region and at a second predetermined spacing along the filament in the front region, and wherein the first predetermined spacing is greater than the second predetermined spacing.

9. The apparatus according to claim 1, wherein the second hair members do not comprise straight hair.

10. The apparatus according to claim 1, wherein the first hair members and the second hair members are not directly coupled to each other.

11. An artificial hair apparatus comprising:

a mesh layer configured to fit around a circumference of a user's head comprising an inner surface, an outer surface, a front region, a rear region, and a circumferential edge region that extends around the front region and the rear region;

a filament coupled to the outer surface of the mesh layer in a plurality of rows, at least a portion of the filament being disposed in each of the front region and the rear region of the mesh layer in one of a longitudinal direction and a transverse direction;

a plurality of first hair members coupled to the filament;

a plurality of second hair members slidably disposed between the filament and the mesh layer, the second hair members comprising a first end and a second end, wherein the first end and the second end of the second hair members are disposed on the outer surface of the mesh layer, wherein the circumferential edge region comprises a rear edge portion, a side edge portion, a temple edge portion, and a front edge portion, and wherein the rear edge portion and the front edge portion are substantially inelastic and the side edge portion and the temple edge portion are substantially elastic.

12. The apparatus according to claim 11, wherein the side edge portion comprises a first side edge and a second side edge, and wherein the filament is coupled to the rear region of the mesh layer from substantially the first edge across the mesh layer in the transverse direction to the second side edge.

13. The apparatus according to claim 11, wherein the rows of filament comprise a first distance between each row in the rear region and a second distance between each row in the front region, and wherein the first distance is greater than the second distance.

14. The apparatus according to claim 11, wherein the front edge portion comprises a first front end edge and a second front end edge, and wherein the filament is coupled to the front region of the mesh layer from substantially the first front end edge across the mesh layer in a serpentine manner to substantially the second front end edge.

15. The apparatus according to claim 11, wherein the circumferential edge region extends around the circumference of the user's head.

16. The apparatus according to claim 11, wherein the temple edge portion is contoured to correspond to the user's hairline.

* * * * *